US009636560B1

(12) United States Patent
Celone et al.

(10) Patent No.: US 9,636,560 B1
(45) Date of Patent: May 2, 2017

(54) BASEBALL TRAINING APPARATUS

(71) Applicant: CPY 2 LLC, Naples, FL (US)

(72) Inventors: Thomas J. Celone, Reno, NV (US); James Yablonowski, Cedar Lake, IN (US); Randall Yablonowski, Plainfield, IN (US); Cindy Yablonowski, Naples, FL (US)

(73) Assignee: CPY 2 LLC, Naples, FL (US)

( * ) Notice: Subject to any disclaimer, the term of this patent is extended or adjusted under 35 U.S.C. 154(b) by 0 days.

(21) Appl. No.: 15/235,915

(22) Filed: Aug. 12, 2016

Related U.S. Application Data

(60) Provisional application No. 62/390,125, filed on Mar. 21, 2016, provisional application No. 62/350,959, filed on Jun. 16, 2016.

(51) Int. Cl.

| | |
|---|---|
| ***A63B 69/00*** | (2006.01) |
| ***A63B 69/34*** | (2006.01) |
| ***A63B 59/40*** | (2015.01) |
| *A63B 59/50* | (2015.01) |

(52) U.S. Cl.
CPC ..... *A63B 69/0002* (2013.01); *A63B 59/40* (2015.10); *A63B 59/50* (2015.10); *A63B 2069/0008* (2013.01)

(58) Field of Classification Search
CPC ..... A63B 69/0002; A63B 2069/0008; A63B 59/40; A63B 59/50
USPC ..... 473/422, 437, 457, 519, 564
See application file for complete search history.

(56) References Cited

U.S. PATENT DOCUMENTS

| | | | | |
|---|---|---|---|---|
| 5,335,918 | A | 8/1994 | Rupnik et al. | |
| 5,803,838 | A * | 9/1998 | DeMarini | A63B 21/0088 473/457 |
| 7,384,344 | B2 | 6/2008 | Aguirre | |
| 8,092,322 | B1 * | 1/2012 | Smallcomb | A63B 69/0002 473/451 |
| 8,202,204 | B2 | 6/2012 | Celone et al. | |
| 8,409,037 | B2 * | 4/2013 | Imatoh | A63B 21/0088 473/457 |
| 8,905,871 | B2 * | 12/2014 | Wagner | A63B 69/0002 473/457 |
| 2008/0261730 | A1 * | 10/2008 | Mullin | A63B 47/02 473/457 |

* cited by examiner

*Primary Examiner* — Mitra Aryanpour
(74) *Attorney, Agent, or Firm* — Nilay J. Choksi; Smith & Hopen, P.A.

(57) ABSTRACT

A sports training device attached to the shaft of a swinging sports apparatus, such as a golf club, tennis racket, baseball bat, hockey stick, or other sports apparatus that is intended to be swung while playing a sport. The device includes proximal and distal attachment mechanisms, where the proximal attachment mechanism is disposed at the proximal end of the device and the distal attachment mechanism is disposed between the proximal and distal ends of the device. A stiffener element is disposed at the distal end of the device, and a drag chute is secured to each end of the device. An elongated rod extends along each side of the panel between the proximal attachment mechanism and the stiffener element. The proximal attachment mechanism is secured to the sports apparatus; the distal attachment mechanism is disposed semi-freely around the sports apparatus. The training device rotates about the sports apparatus in synchronization.

17 Claims, 21 Drawing Sheets

BASEBALL TRAINING APPARATUS

CROSS-REFERENCE TO RELATED APPLICATIONS

This nonprovisional application claims priority to U.S. Provisional Patent Application No. 62/350,959, entitled "Sports Training Device", filed on Jun. 16, 2016, and to U.S. Provisional Patent Application No. 62/390,125, entitled "Big-R-Hitter", filed on Mar. 21, 2016, both of which are incorporated herein by reference in their entireties.

BACKGROUND OF THE INVENTION

1. Field of the Invention

This invention relates, generally, to sports exercise equipment. More specifically, it relates to a device that exercises muscles and improves performance in sports that require swinging an apparatus such as a club, bat, stick, or racket.

2. Brief Description of the Prior Art

Sports training devices are known in the art for aiding in the swinging motion of a piece of sporting equipment, such as a baseball bat. However, they fail to teach or suggest a mechanism that allows the full range of motion without becoming entangled around the shaft of the club, bat, stick, or racket.

One such device is U.S. Pat. No. 5,335,918 to Rupnik et al. This device teaches an attachment to a golf club that only provides air resistance when the club is swung incorrectly. This device attempts to eliminate the slice in a golf swing. Also, the air foil in this invention is made of a stiff material and therefore does not freely move about the shaft based on a user's unique swing.

A previous patent obtained by the Applicant (U.S. Pat. No. 8,202,204 to Celone et al.) teaches an apparatus that is attached by coupling links affixed to the shaft of the club. It also alleges 360° motion about the shaft; however, the device could become entangled around the shaft of the club, bat, stick, or racket, due to the ends of the drag chute being capable of rotating at different speeds, independent of each other.

U.S. Pat. No. 7,384,344 to Aguirre teaches an apparatus that includes a drag chute that is filled with air and kept from becoming entangled by its booms and is attached to a shaft by boom mounts. However, the device in Aguirre does not attach to the club, bat, stick, or racket. Therefore, a user cannot practice hitting the ball as in golf, baseball and tennis, or hit the puck in hockey. This is a serious drawback if the user's goal is to train for a specific sport. Further, the mechanism by which the drag chute couples to the club appears to be quite complex, but it functions for its own purpose since a user cannot remove the training device from the club; rather, it is manufactured to be affixed on the club, thus permitting a greater flexibility for how the training device can be structured.

Accordingly, what is needed is a device that allows a full, 360° range of motion around the shaft of the club, bat, stick, or racket to provide the proper air resistance for training no matter how a person swings the club, bat, stick, or racket. Previous devices have allowed for 360° motion; however, these devices must utilize a static air foil or risk becoming entangled around the shaft of the club, bat, stick, or racket. In view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a sports exercise device that attaches to the elongate shaft of a swinging sports equipment (e.g., club, bat, stick, or racket) by way of annular attachment or a functional equivalent, rotates 360°, and is supported by elongated rods is now met by a new, useful, and nonobvious invention.

In an embodiment, the current invention is a swinging sports exercise/training device for attaching to a shaft of a sports apparatus. The swinging sports exercise/training device includes a proximal attachment mechanism and a distal attachment mechanism, which may be annular in shape. The proximal attachment mechanism is positioned, such that at least a portion of it rotates 360° about a proximal portion of the shaft of the sports apparatus. The distal attachment mechanism is positioned to rotate about a distal portion of the shaft of the sports apparatus. The distal attachment mechanism has an inner diameter that is larger than the outer diameter of the distal portion of the shaft of the sports apparatus, such that the entirety of the distal attachment mechanism substantially freely rotates 360° about the sports apparatus. In an embodiment, the proximal attachment mechanism can have an inner diameter that is smaller than the largest outer diameter of the shaft of the sports apparatus, and the distal attachment mechanism can have an inner diameter that is larger than the largest outer diameter of the shaft of the sports apparatus.

The swinging sports exercise/training device further includes first and second elongated rods (e.g., Young's modulus of at least 10 GPa), each having a proximal and a distal end. The rods are disposed so that the proximal ends are attached to opposing ends of the proximal attachment mechanism and the distal ends are secured to a stiffener element (e.g., corner attachment mechanism, handle formed of a front handle component and a rear handle component)

positioned at the distal end of the training device. Optionally, the rods can be disposed through the distal attachment mechanism as well. The rotation of the attachment mechanisms is synchronized with the rotation of the elongated rods. The mechanisms and the rods rotate around the center axis of the sports apparatuses. Optionally, the rods can be symmetrical with respect to each other about the center axis of the sports apparatus.

The swinging sports exercise/training device further includes a panel with a proximal end secured to the proximal end of the training device and a distal end secured to the distal end of the training device. The panel's proximal end is attached to the proximal attachment mechanism, and the panel's distal end is attached to the stiffener element (e.g., if the stiffener handle is a handle formed of a front handle component and a rear handle component, the distal edge of the panel can be secured therebetween). Optionally, the panel can be substantially taut when the training device is in use.

With this configuration, the training device can rotate about the shaft of the sports apparatus in a direction normal to a velocity vector of a swing so that the user of the sports apparatus experiences an increased resistance during the swing. Further, the rotating portion of the proximal attachment mechanism, the distal attachment mechanism, the stiffener element, the elongated rods, and the panel collectively rotate in synchronization with each other.

The proximal attachment mechanism of the training device may include an inner bearing and outer bearing, where the inner bearing is immovably secured around the proximal portion of the shaft of the sports apparatus and the outer bearing is disposed around the inner bearing and rotatable about both the inner bearing and the proximal portion of the shaft of the sports apparatus. In a further embodiment, the proximal attachment mechanism may further include a collar and a collar cap that house the inner and outer bearings. In yet another embodiment, the inner and outer bearing may each include a raised lip, such that the inner bearing raised lip is seated on the outer bearing raised lip in order to prevent the inner bearing from withdrawing out of the outer bearing.

The distal attachment mechanism may be formed of a collar and a collar cap disposed around the distal portion of the shaft of the sports apparatus.

Optionally, the length of the first elongated rod is substantially parallel to one side edge of the panel, and the length of the second elongated rod is substantially parallel to the other side edge of the panel. In a further embodiment, the panel can have a trapezoidal shape, such that the elongated rods are disposed oblique to each other along the side edges of the panel.

In a separate embodiment, the current invention is a swinging sports exercise and training device for attaching to a shaft of a sports apparatus, where the device includes any one or more, or even all, of the foregoing characteristics and features.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
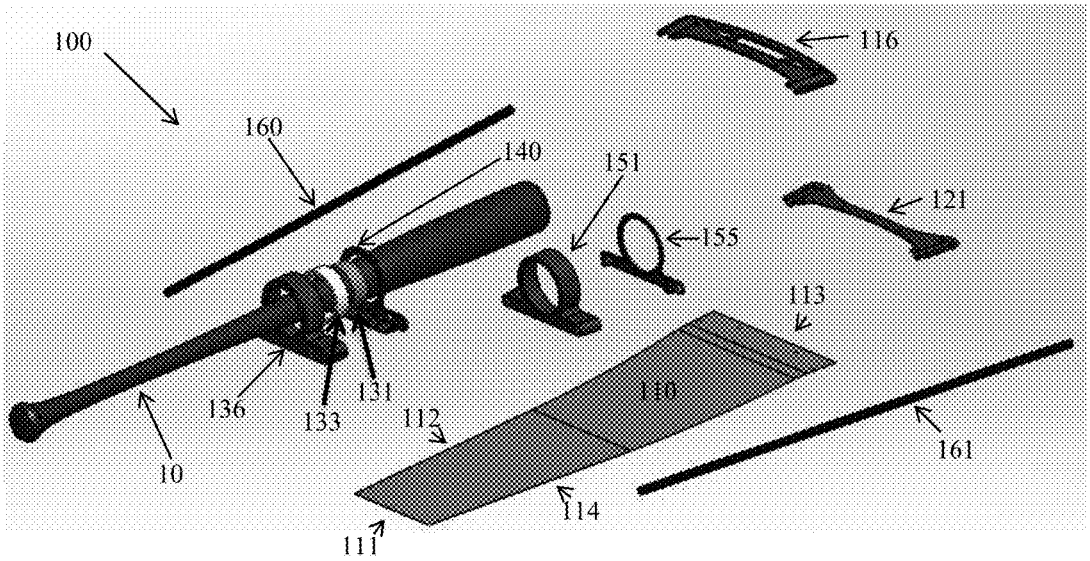
FIG. 1 is a close up exploded view of the sports swinging exercise and training device from the right side perspective.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

The present invention is a swinging sports exercise and training device designed for attachment to the shaft of a swinging sports apparatus, such as a baseball bat. The invention will be described and illustrated herein as applied to a baseball bat, but it can be understood how the device can be applied to other swinging sports apparatuses as well. The device has two connection points (proximal and distal connection points) on the bat and slides over the handle of the bat until both connection points are positioned around the shaft of the bat. The term "proximal" is used herein to refer to a relative position of a structural component being closer to a user of the underlying swinging sports apparatus, whereas the term "distal" is used herein to refer to a relative position of a structural component being further from the user of the underlying swinging sports apparatus. The proximal connection point typically is disposed near one end of the device. The distal connection point is disposed either near the opposite end of the device or in the middle of the device, with other components disposed distal to the distal connection point. This latter configuration will become clearer as this specification continues.

Once both connection points are positioned around the shaft of the bat, the training device continues to slide distally until an inner bearing in the proximal connection point tightens around the shaft of the bat to secure the device to the bat. This typically occurs when the diameter of the shaft of the bat increases to where the shaft abuts the inner perimeter of the proximal connection point and the proximal connection point fits snugly around the shaft. The distal connection point can have an inner diameter that is larger than the largest outer diameter of the bat, thus allowing the distal connection point to remain loose around the shaft of the bat. In this way, the proximal connection point is the primary mechanism by which the training device is secured to the shaft of the bat.

A drag chute extends from the proximal connection point of the apparatus to the distal connection point, or alternatively past the distal connection point to the handle or other rigid support member of the device at the opposite (distal) end of the training device. Two support rods, one on each side of the chute, are affixed and disposed between the ends of the training device, for example between the proximal connection point and the distal connection point, or optionally also between proximal connection point and the handle. In the latter configuration, the support rods can be disposed through the distal connection point as well.

The proximal connection point can rotate 360° in a nearly frictionless manner because an outer bearing is disposed in outer relation to the inner bearing and rotates about the inner bearing of the proximal connection point. A collar and collar cap can house these outer and inner bearings. The distal connection point, formed a collar and collar cap, can also rotate 360° in a nearly frictionless manner because it is semi-loosely positioned around the distal end of the bat, such that it rotates around the distal end of the bat. In other words, the diameter of the upper collar of the distal connection point is larger than the largest diameter of the shaft of the bat. The training device rotates simultaneously around the shaft of the bat (thus eliminating any risk of the chute becoming entangled around the shaft of the bat), due to the support rods ensuring that the two connection points and the chute rotate at the same rate around the shaft of the bat.

Example 1

In an embodiment, depicted in FIGS. 1-10, the current invention is a swing training apparatus, generally denoted by the reference numeral 100, as applied to swinging sports apparatus 10. As shown in FIG. 1, which is an exploded view of device 100 from the right side perspective, panel 110 extends the length of device 100. Handle 115 is formed by front handle 116 and rear handle 121. Handle 115 is formed of front handle 116 and rear handle 121. Handle 115 is coupled to and secures third edge 113 of panel 100. Handle 115 attaches to first elongated rod 160 at the corner formed by edges 112, 113 of panel 110. Handle 115 attaches to second elongated rod 161 at the corner formed by edges 113, 114 of panel 110.

Figure 2:
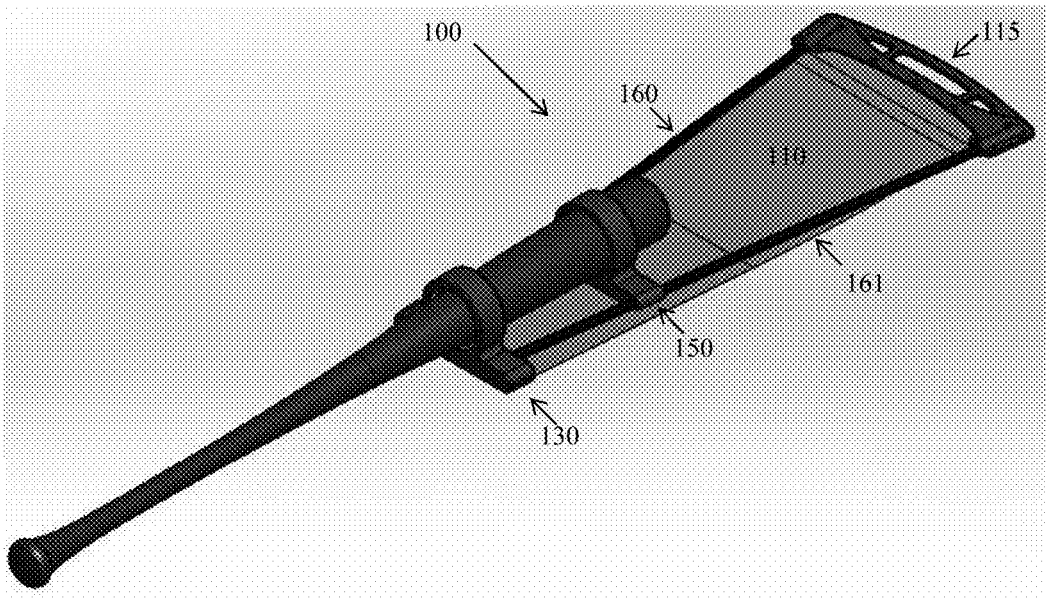
FIG. 2 is an assembled view of the sports swinging exercise and training device attached to the shaft of the sports apparatus from the right side perspective.

First elongated rod 160 is disposed substantially parallel to edge 112. Second elongated rod 161 is disposed substantially parallel to edge 114. Elongated rods 160, 161 optionally are not disposed parallel to each other and rather are oblique to one another, as can be seen in FIG. 2. Elongated rods 160, 161 maintain a constant angle with respect to each other (in other words, the distance between rods 160, 161 remains fixed) and are rotatably indirectly coupled to the shaft of sports apparatus 10 via first (proximal, lower) attachment mechanism 130 and second (distal, upper) attachment mechanism 150.

First attachment mechanism 130 is formed of inner bearing 131, outer bearing 133, collar 136, and collar cap 140. Inner bearing 133 is firmly secured to the shaft of sports apparatus 10 when training apparatus 100 is applied onto sports apparatus 10, as previously discussed, thus allowing no movement of inner bearing 131 about the shaft of sports apparatus 10, typically due to the friction between inner bearing 131 and the shaft of sports apparatus 10. Outer bearing 133 is coupled to inner bearing 131 in a manner to allow outer bearing 133 to rotate 360° about inner bearing 131 and thus also the center axis of the shaft of sports apparatus 10. First attachment mechanism collar 136 houses inner bearing 131 and outer bearing 133. First attachment mechanism collar cap 140 couples to first attachment mechanism collar 136 to fully enclose inner bearing 131 and outer bearing 133. Edge 111 of panel 110 is disposed in proximity to first attachment mechanism 130 and has approximately the same length as first attachment mechanism 130. Edge 111 of panel 110 is coupled to first attachment mechanism 130 at a proximal end of training apparatus 100.

In certain embodiments, it is contemplated herein that second attachment mechanism 150 can take a similar configuration as first attachment mechanism 130 with the inner bearing secured to sports apparatus 10 and the outer bearing rotating about the inner bearing. However, if sports apparatus 10 has varying diameters along its length, as many baseball bats do, a simpler mechanism is presented herein. Second attachment mechanism 150 can be formed of second attachment mechanism collar 151 and cap 155, and is laxly disposed around the shaft of sports apparatus 10. Second attachment mechanism 150 has an inner diameter that is larger than the outer diameter of sports apparatus 10 and thus can substantially freely rotate about the shaft of sports apparatus 10 during rotation of training apparatus 100 around sports apparatus 10.

As can be seen most clearly in FIG. 2, elongated rods 160, 161 each have an end affixed/secured to handle 115 and an opposite end affixed/secured to first attachment mechanism 130. By itself, this configuration should maintain the general rigidity of training apparatus 100 as it rotates about sports apparatus 10. For additional control, elongated rods 160, 161 can also be disposed through second attachment mechanism 150 between handle 115 and first attachment mechanism 130. From second attachment mechanism 150, first elongated rod 160 and second elongated rod 161 continue substantially parallel to second edge 112 and fourth edge 114 of panel 110 until reaching and securing to first attachment mechanism 130.

Still referring to FIG. 2, first attachment mechanism 130 is secured to the shaft of sports apparatus 10 so that training apparatus 10 cannot shift along the shaft of sports apparatus 10 but is capable of rotating, nearly without friction, around the shaft of sports apparatus 10. Second attachment mechanism 150 is laxly disposed around the shaft of sports apparatus 10 in a way such that second attachment mechanism 150 can rotate in a nearly frictionless motion around the shaft.

First elongated rod 160 begins and is attached to first attachment mechanism 130, is disposed substantially parallel to second edge 112 of panel 110, is disposed through and/or is attached to second attachment mechanism 150, and terminates at and is attached to handle 115 at the corner of panel 110 formed by the intersection of second edge 112 and third edge 113. Second elongated rod 161 begins and is attached to first attachment mechanism 130, is disposed substantially parallel to fourth edge 114 of panel 110, is disposed through and/or is attached to second attachment mechanism 150, and terminates at and is attached to handle 115 at the corner of panel 110 formed by the intersection of fourth edge 114 and third edge 113. The longitudinal extent of handle 115 is disposed substantially parallel to the length of third edge 113 and is secured to first elongated rod 160 and second elongated rod 161. In this way, training apparatus 100 is configured to rotate 360° around the shaft of sports apparatus 10, with exception to inner bearing 131, which is secured to the shaft of sports apparatus 10 and does not move in any direction during operation of training apparatus 100.

Figure 3:
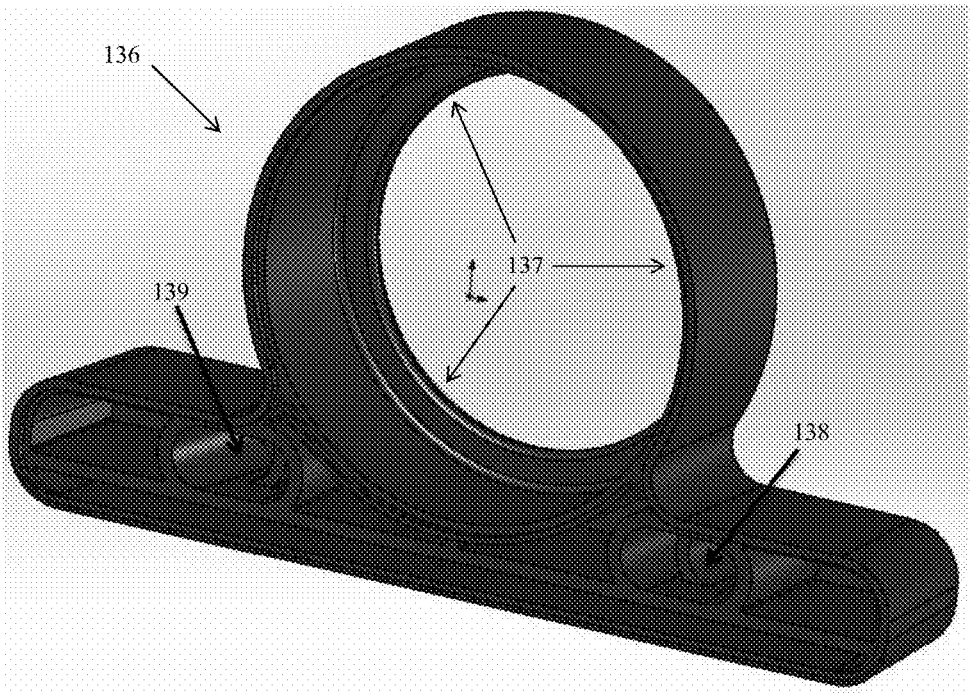
FIG. 3 is a view of the bottom collar of the sports swinging exercise and training device from the right side perspective.

FIG. 3 is a close-up view of first attachment mechanism collar 136. The shaft of sports apparatus 10, outer bearing 133, and inner bearing 131 (none shown in this figure but can be seen in FIGS. 1-2) all fit within annular ring 137 of first attachment mechanism collar 136. As discussed, elongated rods 160, 161 each have an end secured to first attachment mechanism 130. In certain embodiments, first elongated rod 160 (not shown) is secured to collar 136 of first attachment mechanism 130 by snugly fitting into slot or opening 138. In other words, slot or opening 138 receives the proximal end of first elongated rod 160. Similarly, second elongated rod 161 (not shown) can be secured to collar 136 of first attachment mechanism 130 by snugly fitting into slot or opening 139. In other words, slot or opening 139 receives the proximal end of second elongated rod 161.

Figure 4:
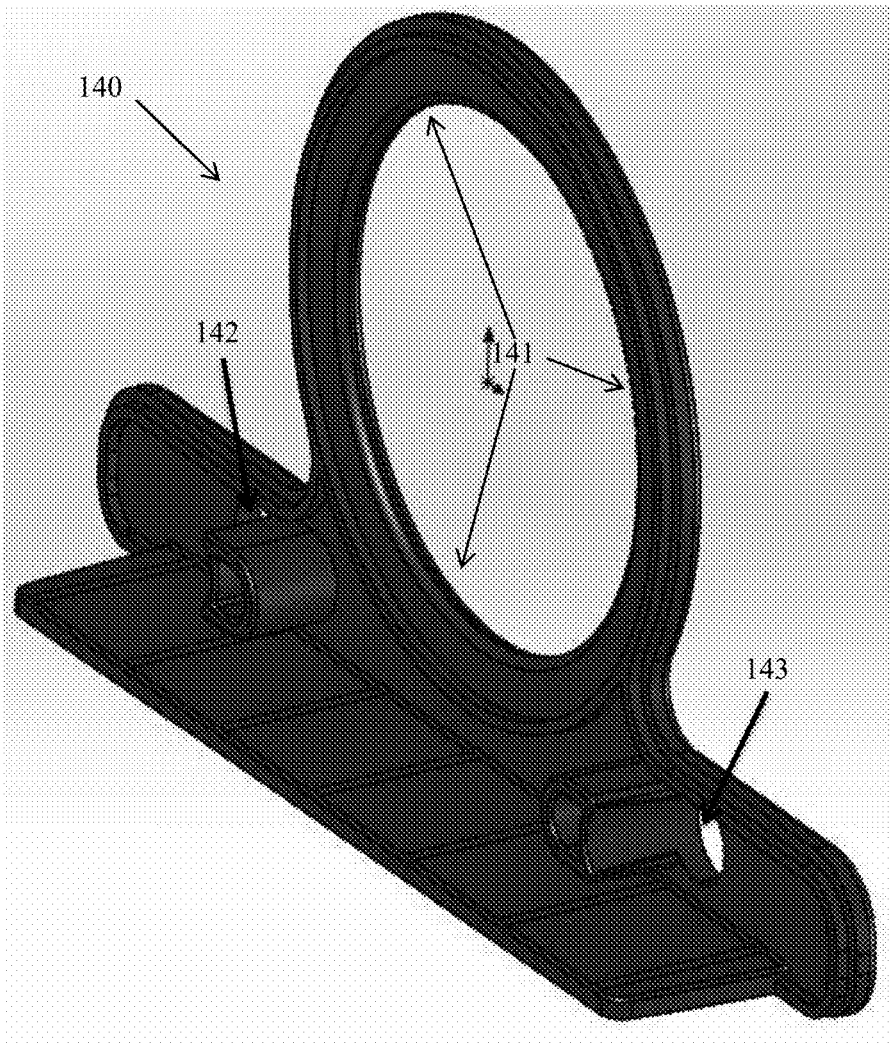
FIG. 4 is a view of the bottom collar cap of the sports swinging exercise and training device from the right side perspective.

Distal to first attachment mechanism collar 136 is first attachment mechanism collar cap 140, a close-up of which can be seen in FIG. 4. First attachment mechanism collar cap 140 is coupled to first attachment mechanism collar 136 and prevents inner bearing 131 and outer bearing 133 from exiting the interior of annular ring 137 of first attachment mechanism collar 136. The shaft of sports apparatus 10, outer bearing 133, and inner bearing 131 (none shown in this figure but can be seen in FIGS. 1-2) all fit within first attachment mechanism collar cap annular ring 141. First elongated rod 160 (not shown) is disposed through opening 142, and second elongated rod 161 (not shown) is disposed through opening 143.

Figure 5:
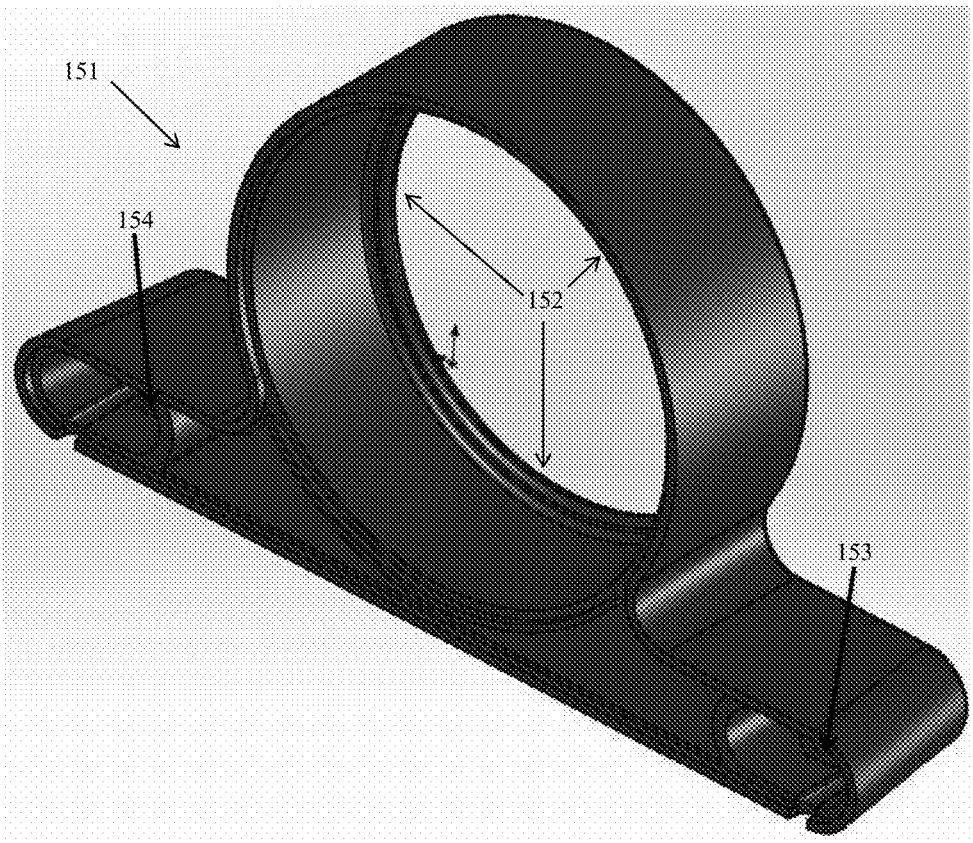
FIG. 5 is a view of the top collar of the sports swinging exercise and training device from the right side perspective.
Figure 6:
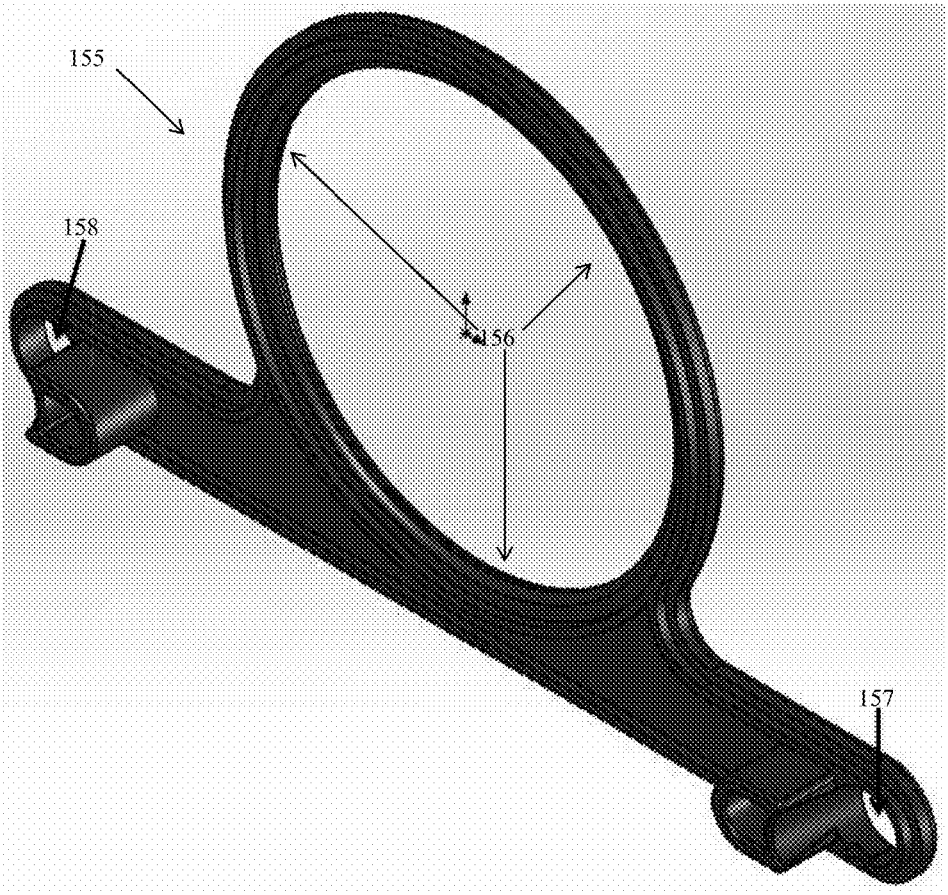
FIG. 6 is a view of the top collar cap of the sports swinging exercise and training device from the right side perspective.

Further distal to first attachment mechanism 130 along elongated rods 160, 161 is second attachment mechanism 150, formed of second attachment mechanism collar 151 and second attachment mechanism collar cap 155, both of which can be seen in isolated views in FIGS. 5 & 6, respectively. Referring to FIG. 5, in particular, second attachment mechanism collar 151 includes annular ring 152 through which the shaft of sports apparatus 10 is disposed during operation of training apparatus 100. As discussed, in certain embodiments, elongated rods 160, 161 can be disposed through second attachment mechanism 150 between handle 115 and first attachment mechanism 130. First elongated rod 160 (not shown) would be disposed through aperture 153, and second elongated rod 161 (not shown) would disposed through aperture 154.

Second attachment mechanism collar cap 155 is shown in FIG. 6 and is coupled to the distal side of second attachment mechanism collar 151, as indicated in FIG. 1, such that the shaft of sports apparatus 10 fits within annular ring 156 of second attachment mechanism collar cap 155. In the embodiments where elongated rods 160, 161 are disposed through second attachment mechanism 150, first elongated rod 160 (not shown) would be disposed through aperture 157, and second elongated rod 161 (not shown) would be disposed through aperture 158.

Figure 7:
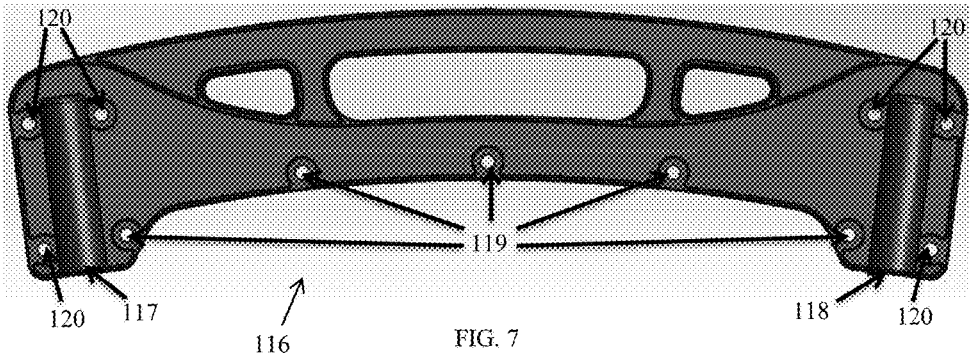
FIG. 7 is a view of the front handle of the sports swinging exercise and training device from the front perspective.
Figure 8:
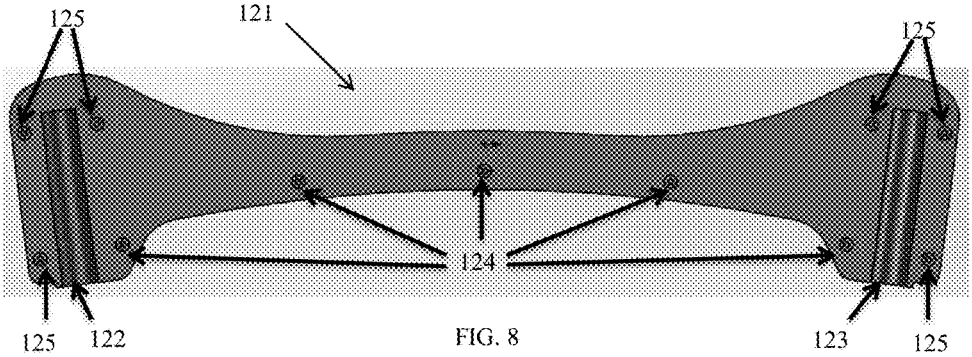
FIG. 8 is a view of the back handle of the sports swinging exercise and training device from the front perspective.

The distal end of training apparatus 100 ends in handle 115 formed of front handle 116, which can be seen in FIG. 7, and rear handle 121, which can be seen in FIG. 8. It should be noted that handle 115 simply be a distal end rigid member that maintains the alignment of panel 110, so that panel 110 does not twist during operation. In certain embodiments, this distal end rigid member can function as a handle as well, but this functionality is optional.

Referring to FIGS. 7-8 in combination, first elongated rod 160 (not shown) is disposed in the channel formed by slot 117 in front handle 116 and slot 122 in rear handle 121. Similarly, second elongated rod 161 (not shown) is disposed in the channel formed by slot 118 in front handle 116 and slot 123 in rear handle 121. Third edge 113 of panel 110 (not shown) is secured between front handle 116 and rear handle 121 with fastening devices in panel securing apertures 119 in front handle 116 and corresponding panel securing apertures 124 in rear handle 121, where apertures 119, 124 are aligned with each other to secure third edge 113 of panel 110 therebetween. Securing apertures 120 of front handle 116 and securing apertures 125 of rear handle 121 are aligned with one another and can be used with conventional fastening devices to secure front handle 116 and back handle 121 together.

Figure 9:
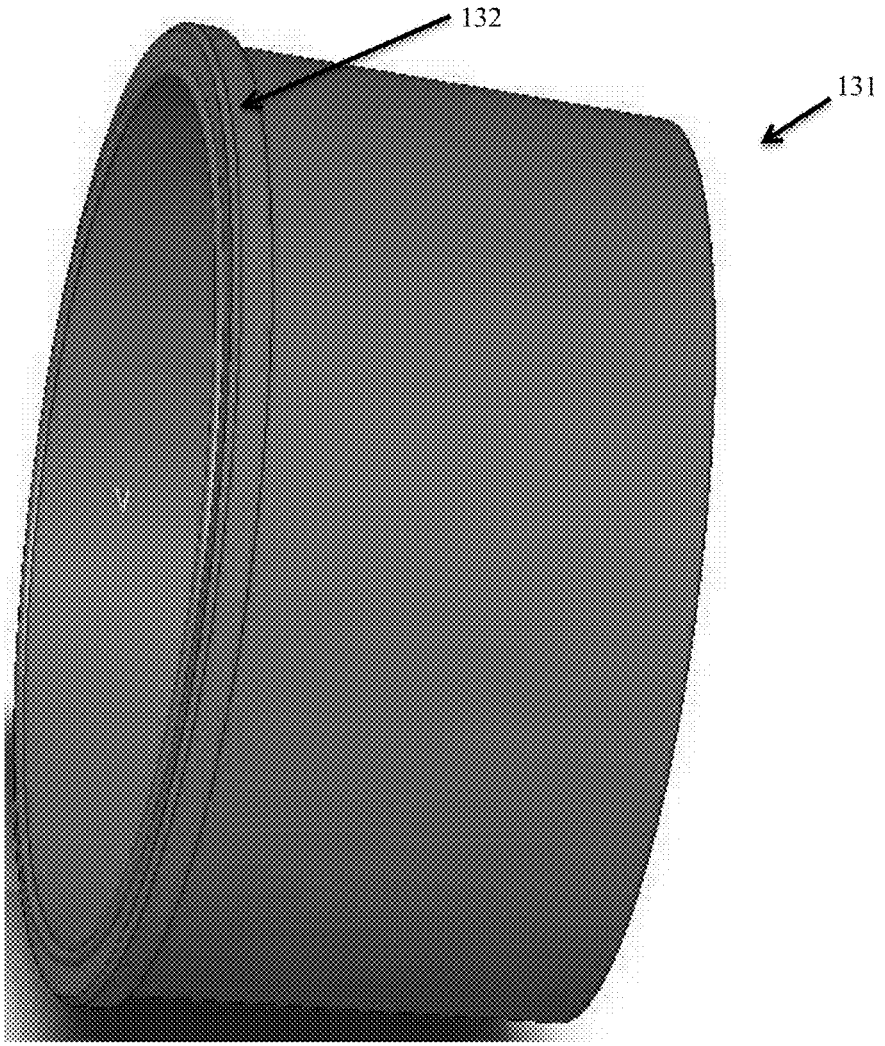
FIG. 9 is a view of the inner bearing of the sports swinging exercise and training device from the left side perspective.
Figure 10:
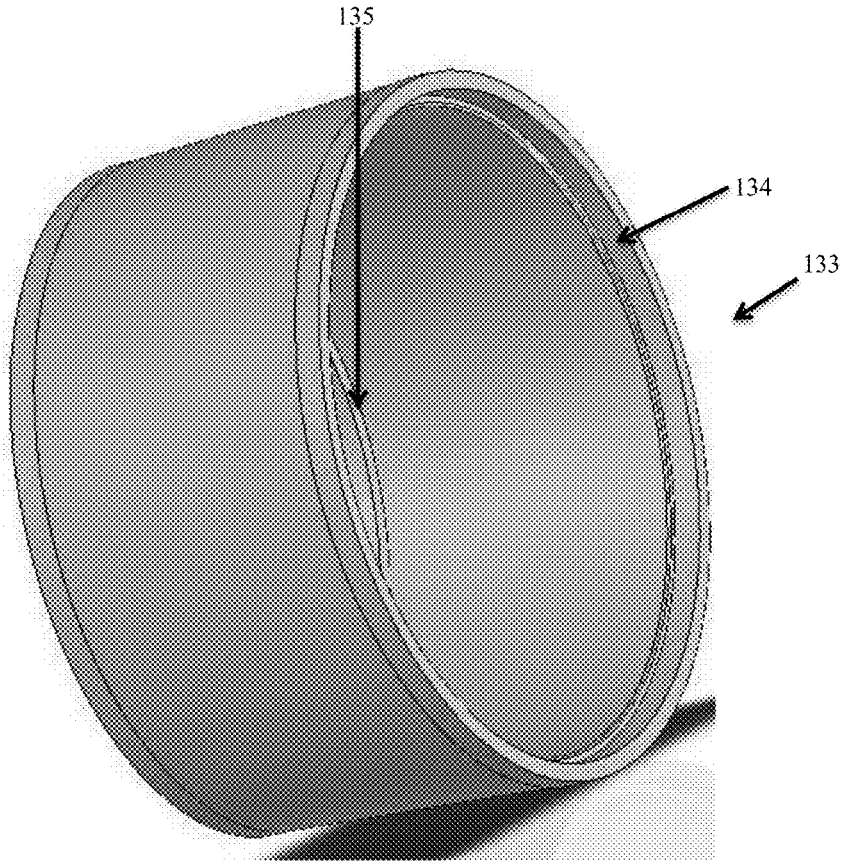
FIG. 10 is a view of the outer bearing of the sports swinging exercise and training device from the right side perspective.

Isolated views of inner bearing 131 and outer bearing 133 can be seen in FIGS. 9 & 10, respectively. Inner bearing lip 132 is raised slightly so that inner bearing 131 can fit within outer bearing 133 without sliding out. The inner circumference of inner bearing 131 is disposed and secured around the outer circumference of the shaft of sports apparatus 10.

Outer bearing 133 includes first lip 134 having a slightly larger inner diameter than the remainder of outer bearing 133. This permits inner bearing lip 132 to fit within outer bearing 134, while also preventing inner bearing 131 from sliding through outer bearing 133. Outer bearing 133 also includes second lip 135 having a slightly smaller inner diameter than the remainder of outer bearing 133. This also aids in prohibiting inner bearing 131 from sliding through outer bearing 133. First attachment mechanism collar 136 and first attachment mechanism collar cap 140 are disposed snugly around both of inner bearing 131 and outer bearing 133 to secure them together.

Example 2

Figure 11:
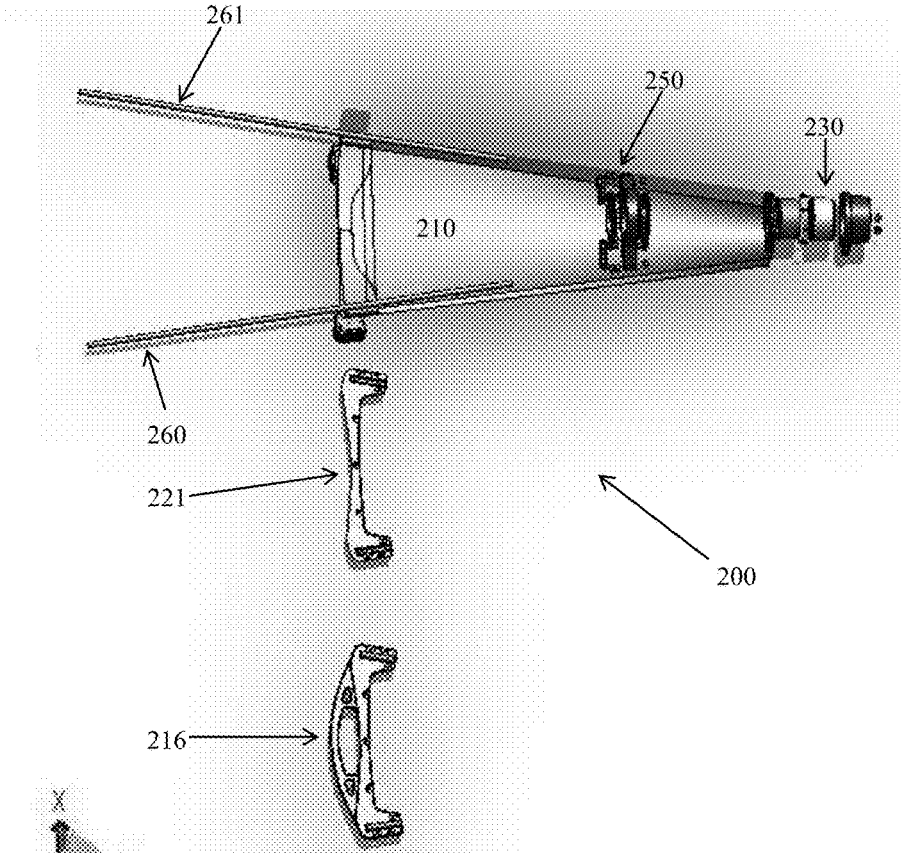
FIG. 11 is an exploded view of the sports swinging exercise and training device from the front view perspective.
Figure 12:
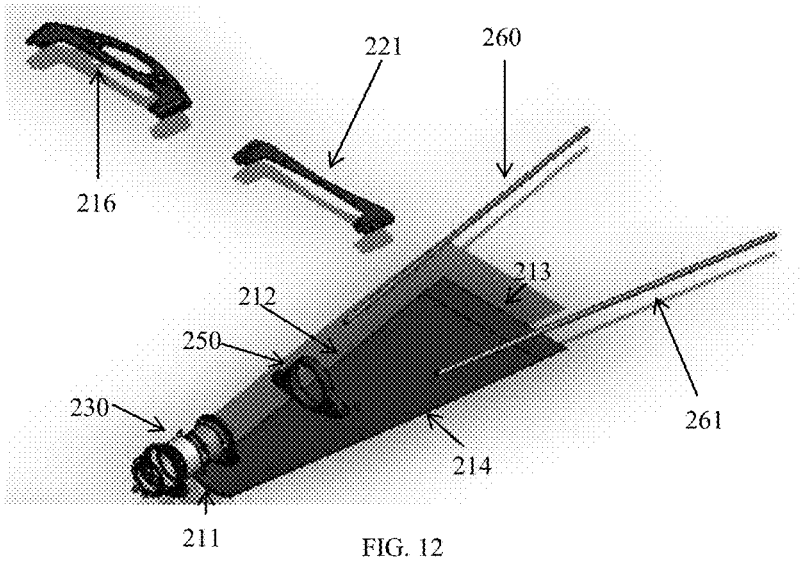
FIG. 12 is an exploded view of the sports swinging exercise and training device from the right side perspective.
Figure 13:
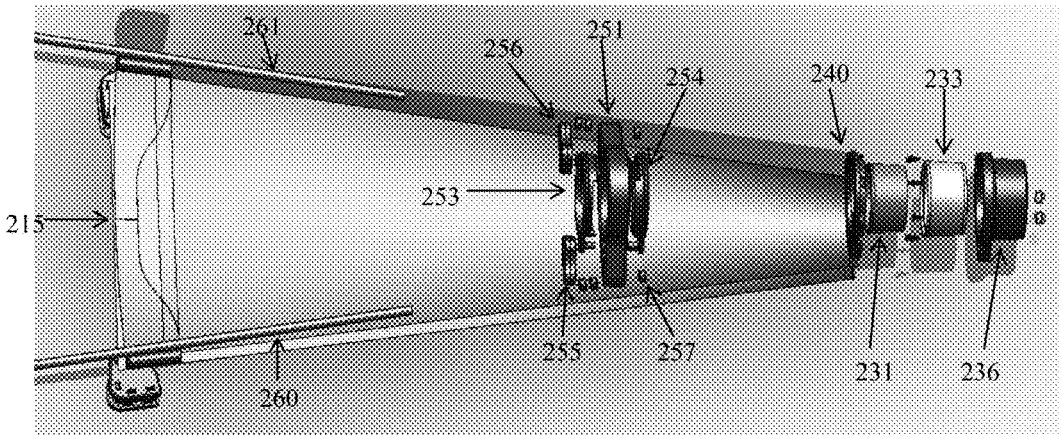
FIG. 13 is a close up exploded view of the sports swinging exercise and training device front the front perspective.

In an embodiment, depicted in FIGS. 11-21, the current invention is a swing training apparatus, generally denoted by the reference numeral 200, as applied to swinging sports apparatus 20. As shown in FIGS. 11-13, which are exploded views of an alternative embodiment of training apparatus 200 from different angles, panel 210 extends the length of device 200. Handle 215 is formed by front handle 216 and back handle 221. Handle 215 is coupled to and secures third edge 213 of panel 210. Handle 215 attaches to first elongated rod 260 at the corner formed by edges 212, 213 of panel 210. Handle 215 attaches to second elongated rod 261 at the corner formed by edges 213, 214 of panel 210.

Figure 16:
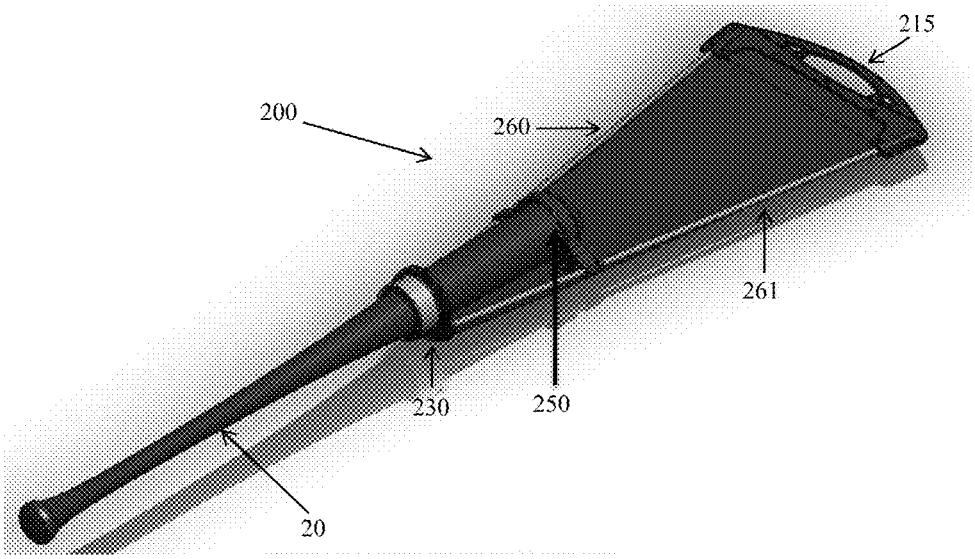
FIG. 16 is an assembled view of the sports swinging exercise and training device attached to the shaft of the sports apparatus from the right side perspective.
Figure 17:
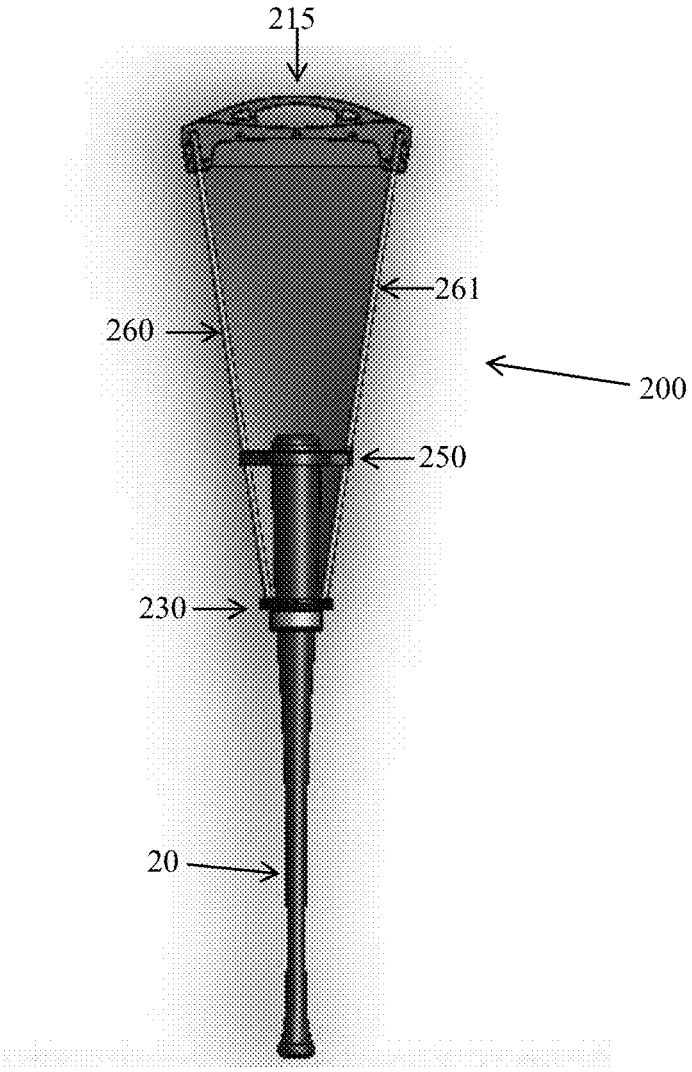
FIG. 17 is an assembled view of the sports swinging exercise and training device attached to the shaft of the sports apparatus from the front side perspective.

First elongated rod 260 is disposed substantially parallel to edge 212. Second elongated rod 261 is disposed substantially parallel to edge 214. Elongated rods 260, 261 optionally are not disposed parallel to each other and rather are oblique to one another, as can be seen in FIGS. 16 & 17. Elongated rods 260, 261 maintain a constant angle with respect to each other (in other words, the distance between rods 260, 261 remains fixed) and are rotatably indirectly coupled to the shaft of sports apparatus 20 via first (proximal, lower) attachment mechanism 230 and second (distal, upper) attachment mechanism 250.

Figure 14:
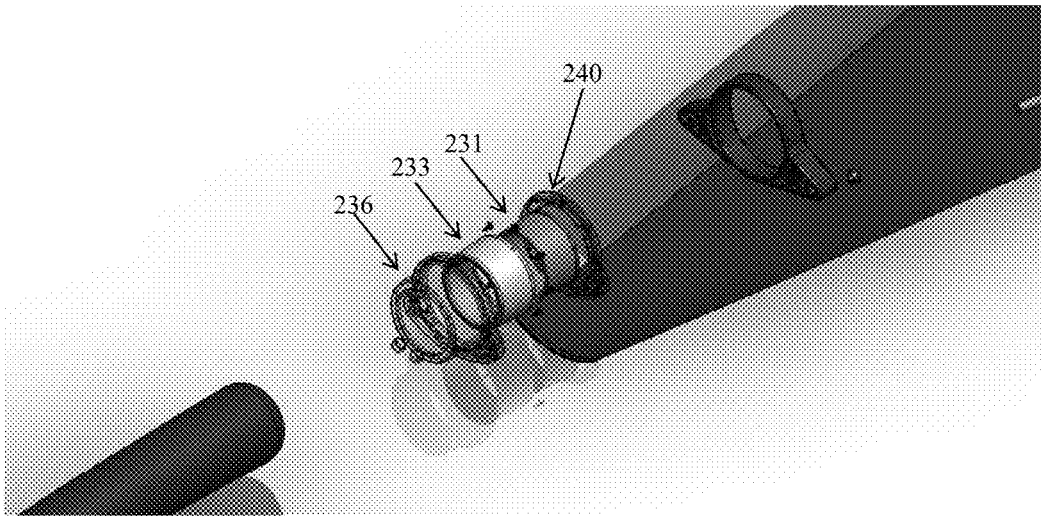
FIG. 14 is a close up exploded view of the sports swinging exercise and training device from the right side perspective.

Referring to FIG. 14 in particular, first attachment mechanism 230 is formed of inner bearing 231, outer bearing 233, collar 236, and collar cap 240. Inner bearing 231 is firmly secured to the shaft of sports apparatus 20 when training apparatus 200 is applied onto sports apparatus 20, as previously discussed, thus allowing no movement of inner bearing 231 about the shaft of sports apparatus 20, typically due to the friction between inner bearing 231 and the shaft of sports apparatus 20. Outer bearing 233 is coupled to inner bearing 231 in a manner to allow outer bearing 233 to rotate 360° about affixed inner bearing 231 and thus also the center axis of the shaft of sports apparatus 20. First attachment mechanism collar 236 houses inner bearing 231 and outer bearing 233. First attachment mechanism collar cap 240 couples to first attachment mechanism collar 236 to fully enclose inner bearing 231 and outer bearing 233. Edge 211 of panel 210 is disposed in proximity to first attachment mechanism 230 and has approximately the same length as first attachment mechanism 230. Edge 211 of panel 210 is coupled to first attachment mechanism 230 at a proximal end of training apparatus 200.

In certain embodiments, it is contemplated herein that second attachment mechanism 250 can take a similar configuration as first attachment mechanism 230 with the inner bearing secured to sports apparatus 20 and the outer bearing rotating about the inner bearing. However, if sports apparatus 20 has varying diameters along its length, as many baseball bats do, a simpler mechanism is presented herein. Second attachment mechanism 250 can be formed of collar 251, upper collar cap 253, lower collar cap 254, first aperture 255, second aperture 256, and a plurality of spacers 257. Second attachment mechanism 250 is laxly disposed around the shaft of sports apparatus 20. Second attachment mechanism 250 has an inner diameter that is larger than the outer diameter of sports apparatus 20 and thus can substantially freely rotate about the shaft of sports apparatus 20 during rotation of training apparatus 200 around sports apparatus 20.

Figure 15:
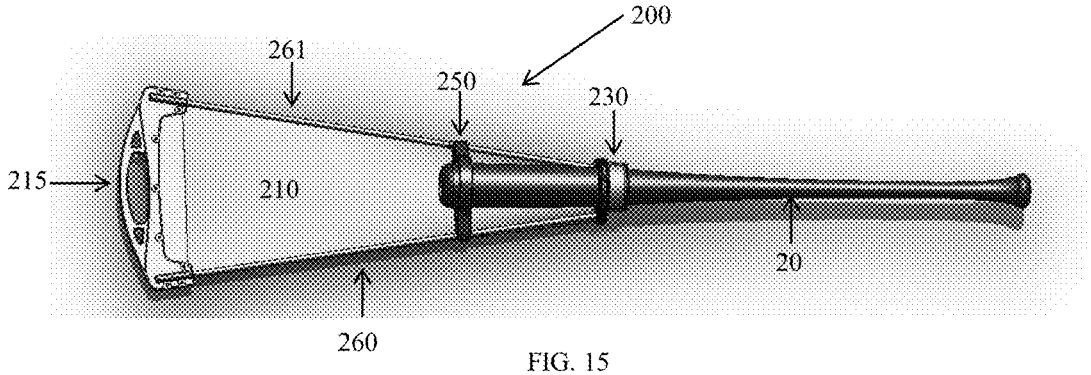
FIG. 15 is an assembled view of the sports swinging exercise and training device attached to the shaft of the sports apparatus from the front side perspective with the device turned counterclockwise 90°.

As can be seen most clearly in FIGS. 15-17, elongated rods 260, 261 each have an end affixed/secured to handle 215 and an opposite end affixed/secured to first attachment mechanism 230. By itself, this configuration should maintain the general rigidity of training apparatus 200 as it rotates about sports apparatus 20. For additional control, elongated rods 260, 261 can also be disposed through second attachment mechanism 250 between handle 215 and first attachment mechanism 230. From second attachment mechanism 250, first elongated rod 260 and second elongated rod 261 continue substantially parallel to second edge 212 and fourth edge 214 of panel 210 until reaching and securing to first attachment mechanism 230.

First attachment mechanism 230 is secured to the shaft of sports apparatus 20 so that training apparatus 20 cannot shift along the shaft of sports apparatus 20 but is capable of rotating, nearly without friction, around the shaft of sports apparatus 20. Second attachment mechanism 250 is laxly disposed around the shaft of sports apparatus 20 in a way such that second attachment mechanism 250 can rotate in a nearly frictionless motion around the shaft.

First elongated rod 260 begins and is attached to first attachment mechanism 230, is disposed substantially parallel to second edge 212 of panel 210, is disposed through and/or is attached to second attachment mechanism 250, and terminates at and is attached to handle 215 at the corner of panel 210 formed by the intersection of second edge 212 and third edge 213. Second elongated rod 261 begins and is attached to first attachment mechanism 230, is disposed substantially parallel to fourth edge 214 of panel 210, is disposed through and/or is attached to second attachment mechanism 250, and terminates at and is attached to handle 215 at the corner of panel 210 formed by the intersection of fourth edge 214 and third edge 213. The longitudinal extent of handle 215 is disposed substantially parallel to the length of third edge 213 and is secured to first elongated rod 260 and second elongated rod 261. In this way, training apparatus 200 is configured to rotate 360° around the shaft of sports apparatus 20, with exception to inner bearing 231, which is secured to the shaft of sports apparatus 20 and does not move in any direction during operation of training apparatus 200.

It is contemplated herein that first attachment mechanism 230—formed of inner bearing 231, outer bearing 233, first attachment mechanism collar 236, and first attachment mechanism collar cap 240—functions similar to first attachment mechanism 130 of Example 1. Further distal to first attachment mechanism 230 along elongated rods 260, 261 is second attachment mechanism 250 (seen most clearly in FIG. 13). Second attachment mechanism 250 includes collar 251, upper collar cap 253, and lower collar cap 254, through which the shaft of sports apparatus 20 is disposed during operation of training apparatus 200. The inner diameter of collar 251, upper collar cap 253, and lower collar cap 254 typically is slightly larger than the largest outer diameter of the shaft of sports apparatus 20, so that second attachment mechanism 250 can rotate about the central axis of the shaft of sports apparatus 20. In the embodiments where elongated rods 260, 261 are disposed through second attachment mechanism 250 between handle 215 and first attachment mechanism 230, first elongated rod 260 would be disposed through first aperture 255, and second elongated rod 261 would be disposed through second aperture 256.

Figure 18:
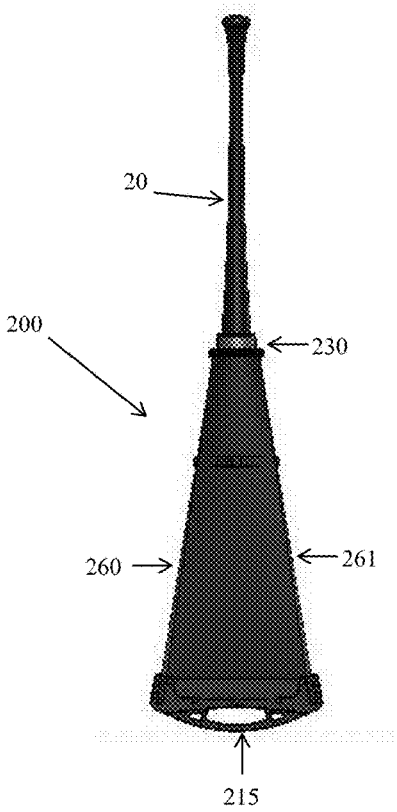
FIG. 18 is an assembled view of the sports swinging exercise and training device attached to the shaft of the sports apparatus from the back side of the device.
Figure 19:
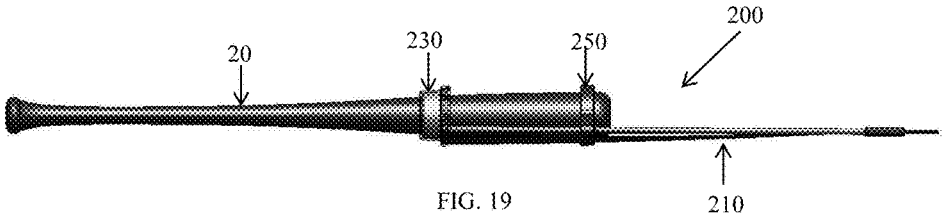
FIG. 19 is an assembled view of the sports swinging exercise and training device attached to the shaft of the sports apparatus from the right side of the device.

As can be seen in FIG. 18, handle 215 is coupled to panel 210 and first and second elongated rods 260, 261. First and second elongated rods 260, 261 extend down the side of training apparatus 200 until reaching and attaching to first attachment mechanism 230.

Figure 20:
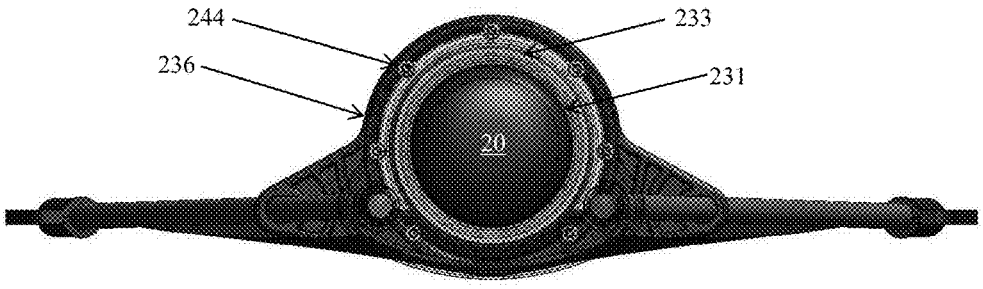
FIG. 20 is an assembled view of the sports swinging exercise and training device attached to the shaft of the sports apparatus from the bottom end of the device.
Figure 21:
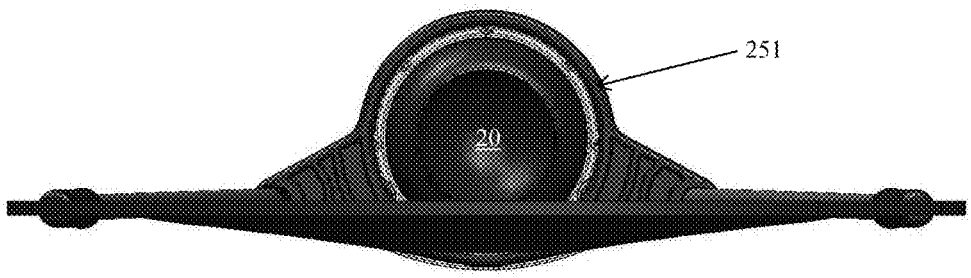
FIG. 21 is an assembled view of the sports swinging exercise and training device attached to the shaft of the sports apparatus from the top end of the device.

FIGS. 20-21 are end views of training apparatus 200 installed on sports apparatus 20. Referring to FIG. 20, inner bearing 231, outer bearing 233, first attachment mechanism collar 236, and first attachment mechanism securing rivets 244 are depicted. Inner bearing 231 can be seen secured around the shaft of sports apparatus 20 and does not move in any direction due to the friction between inner bearing 231 and the shaft of sports apparatus 20. As discussed previously, outer bearing 233 is coupled to and disposed around the perimeter of inner bearing 231 in a manner that permits 360° rotation of outer bearing 233 about the center axis of the shaft of sports apparatus 20. First attachment mechanism collar 236 is disposed around outer bearing 233, such that the rotation of first attachment mechanism collar 236 and outer bearing 233 are synchronized with the remainder of training apparatus 200, with exception to inner bearing 231.

Optional securing rivets 244 are positioned in locations at which first attachment mechanism collar 236 is coupled to outer bearing 233 to further prevent outer bearing 233 from sliding out of first attachment mechanism collar 236, and also to facilitate synchronized rotation of outer bearing 233 and collar 236.

Now referring to FIG. 21, second attachment mechanism collar 251 is laxly disposed around the shaft of sports apparatus 20, thus permitting free rotation of second attachment mechanism 250 about the shaft of sports apparatus 20. It is noted that second attachment mechanism 250 rotates in synchronization with first attachment mechanism 230 about the shaft of sports apparatus 20, due to elongated rods 260, 261 being coupled to handle 215 and first attachment mechanism 230 and disposed through second attachment mechanism 250. Thus, the distance between first attachment mechanism 230 and second attachment mechanism 250 remains unchanged during operation of training apparatus 200.

Example 3

Figure 22:
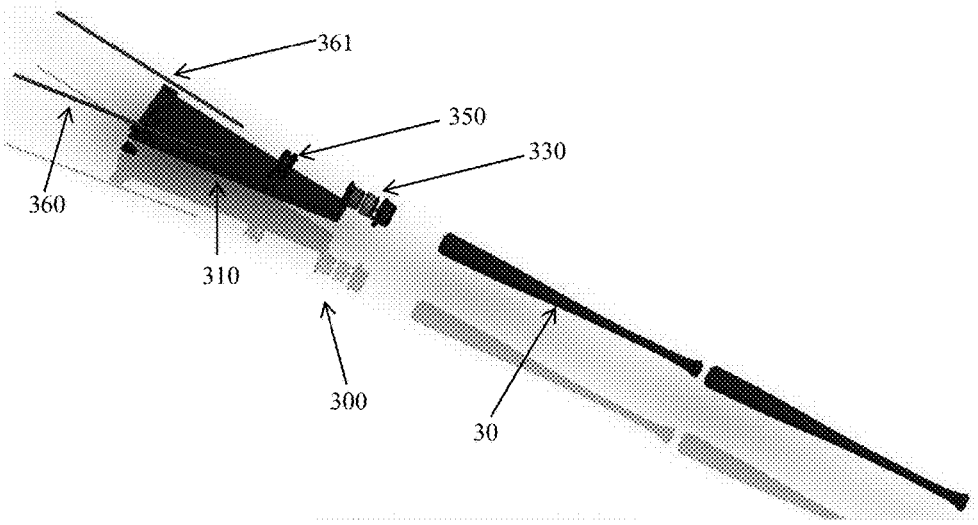
FIG. 22 is an exploded view of the sports swinging exercise and training device from the left side perspective.
Figure 23:
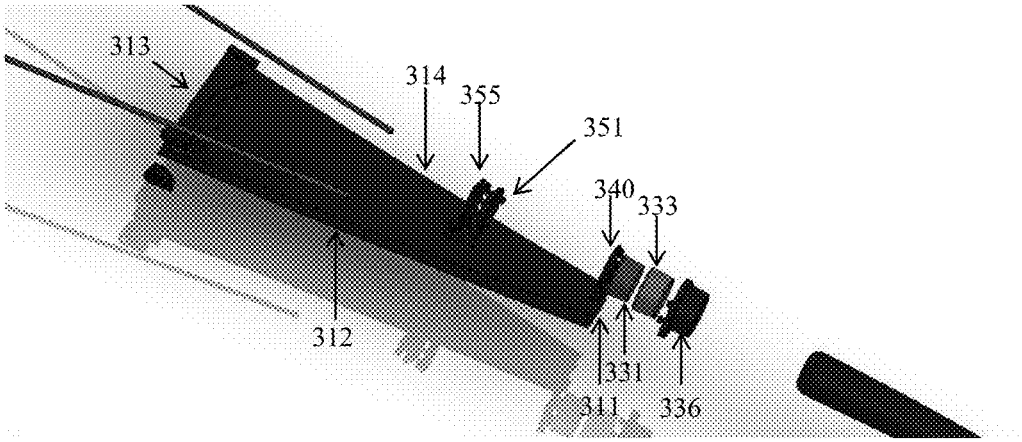
FIG. 23 is a close up exploded view of the sports swinging exercise and training device from the left side perspective.

In an embodiment, depicted in FIGS. 22-31, the current invention is a swing training apparatus, generally denoted by the reference numeral 300, as applied to swinging sports apparatus 30. As shown in FIGS. 22-23, which are exploded views of an alternative embodiment of training apparatus 300, panel 310 extends the length of device 300. Left corner attachment mechanism 315 attaches to first elongated rod 360 at the corner formed by edges 312, 313 of panel 310. Right corner attachment mechanism 316 attaches to second elongated rod 361 at the corner formed by edges 313, 314 of panel 310.

Figure 24:
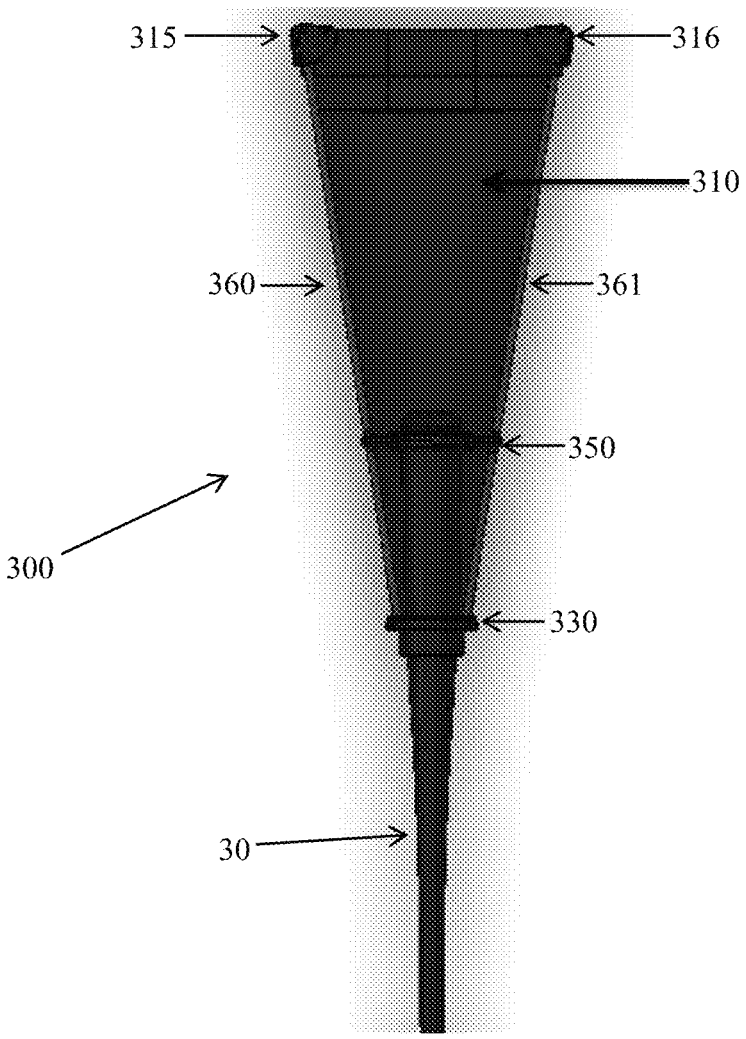
FIG. 24 is an assembled view of the sports swinging exercise and training device attached to the shaft of the sports apparatus from the front side of the device.
Figure 25:
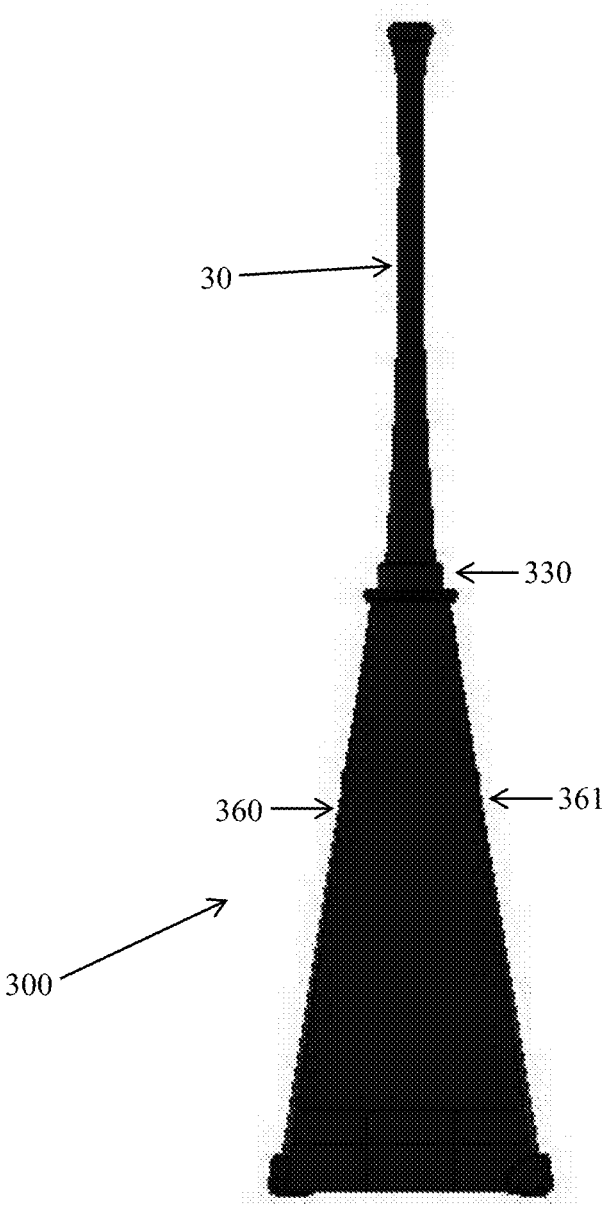
FIG. 25 is an assembled view of the sports swinging exercise and training device attached to the shaft of the sports apparatus from the back side of the device.
Figure 26:
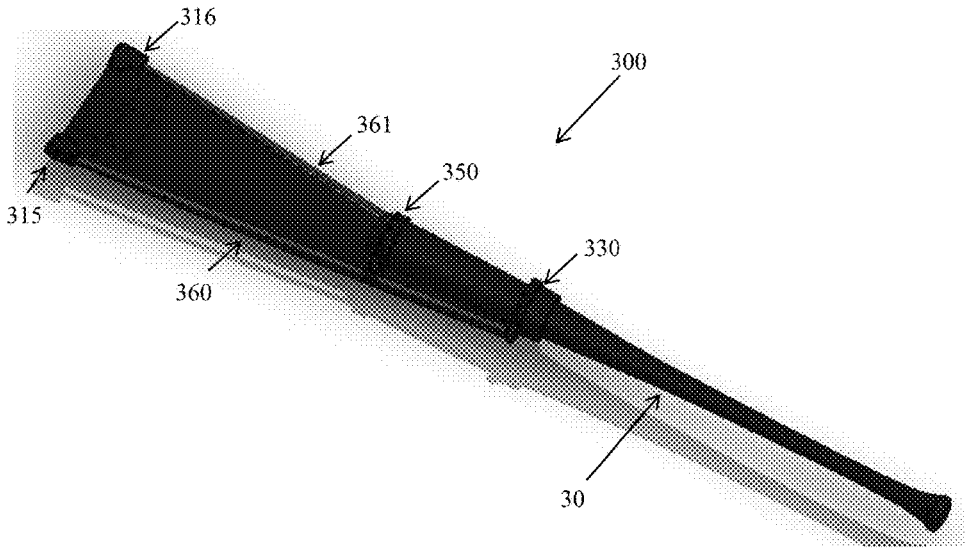
FIG. 26 is an assembled view of the sports swinging exercise and training device attached to the shaft of the sports apparatus from the left side perspective.
Figure 27:
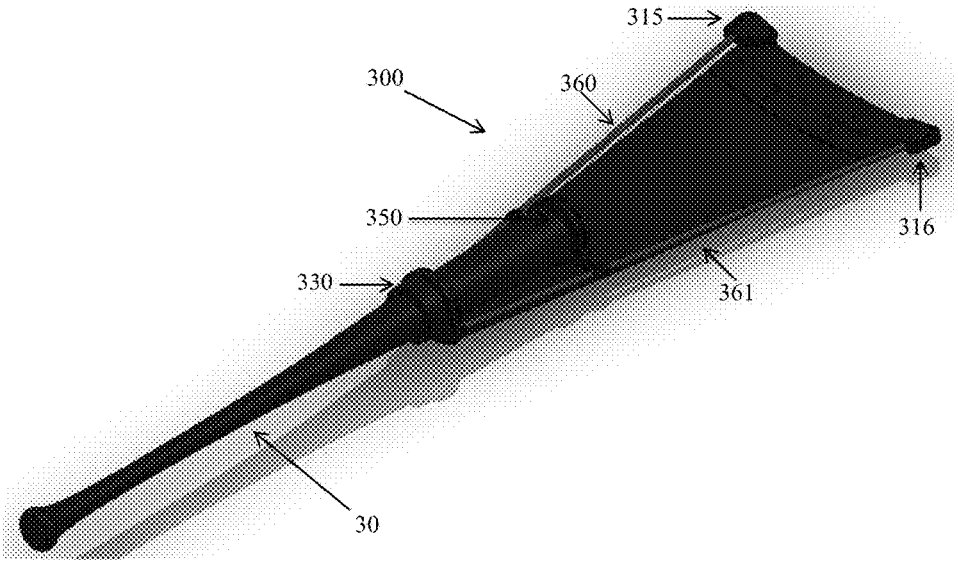
FIG. 27 is an assembled view of the sports swinging exercise and training device attached to the shaft of the sports apparatus from the right side perspective.
Figure 28:
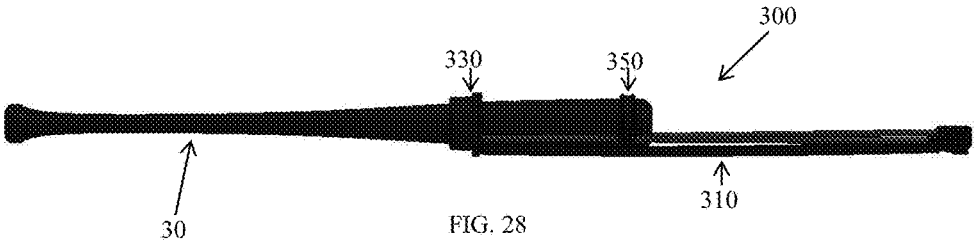
FIG. 28 is an assembled view of the sports swinging exercise and training device attached to the shaft of the sports apparatus from the right side of the device.

First elongated rod 360 is disposed substantially parallel to edge 312. Second elongated rod 361 is disposed substantially parallel to edge 314. Elongated rods 360, 361 optionally are not disposed parallel to each other and rather are oblique to one another, as can be seen in FIGS. 24, 26, and 27. Elongated rods 360, 361 maintain a constant angle with respect to each other (in other words, the distance between rods 360, 361 remains fixed) and are rotatably indirectly coupled to the shaft of sports apparatus 30 via first (proximal, lower) attachment mechanism 330 and second (distal, upper) attachment mechanism 350.

Referring to FIGS. 22 & 23 in particular, first attachment mechanism 330 is formed of inner bearing 331, outer bearing 333, collar 336, and collar cap 340. Inner bearing 331 is firmly secured to the shaft of sports apparatus 30 when training apparatus 300 is applied onto sports apparatus 30, as previously discussed, thus allowing no movement of inner bearing 331 about the shaft of sports apparatus 30, typically due to the friction between inner bearing 331 and the shaft of sports apparatus 30. Outer bearing 333 is coupled to inner bearing 331 in a manner to allow outer bearing 333 to rotate 360° about affixed inner bearing 331 and thus also the center axis of the shaft of sports apparatus 30. First attachment mechanism collar 336 houses inner bearing 331 and outer bearing 333. First attachment mechanism collar cap 340 couples to first attachment mechanism collar 336 to fully enclose inner bearing 331 and outer bearing 333. Edge 311 of panel 310 is disposed in proximity to first attachment mechanism 330 and has approximately the same length as first attachment mechanism 330. Edge 311 of panel 310 is coupled to first attachment mechanism 330 at a proximal end of training apparatus 300.

In certain embodiments, it is contemplated herein that second attachment mechanism 350 can take a similar configuration as first attachment mechanism 330 with the inner bearing secured to sports apparatus 30 and the outer bearing rotating about the inner bearing. However, if sports apparatus 30 has varying diameters along its length, as many baseball bats do, a simpler mechanism is presented herein. Second attachment mechanism 350 can be formed of second attachment mechanism collar 351 and cap 355, and is laxly disposed around the shaft of sports apparatus 30. Second attachment mechanism 350 has an inner diameter that is larger than the outer diameter of sports apparatus 30 and thus can substantially freely rotate about the shaft of sports apparatus 30 during rotation of training apparatus 300 around sports apparatus 30.

As can be seen most clearly in FIGS. 24, 26, and 27, elongated rods 360, 361 each have an end affixed/secured to handle 315 and an opposite end affixed/secured to first attachment mechanism 330. By itself, this configuration should maintain the general rigidity of training apparatus 300 as it rotates about sports apparatus 30. For additional control, elongated rods 360, 361 can also be disposed through second attachment mechanism 350 between handle 315 and first attachment mechanism 330. From second attachment mechanism 350, first elongated rod 360 and second elongated rod 361 continue substantially parallel to second edge 312 and fourth edge 314 of panel 310 until reaching and securing to first attachment mechanism 330.

First attachment mechanism 330 is secured to the shaft of the sports apparatus so that training apparatus 30 cannot shift along the shaft of sports apparatus 30 but is capable of rotating, nearly without friction, around the shaft of sports apparatus 30. Second attachment mechanism 350 is laxly disposed around the shaft of sports apparatus 30 in a way such that second attachment mechanism 350 can rotate in a nearly frictionless motion around the shaft.

First elongated rod 360 begins and is attached to first attachment mechanism 330, is disposed substantially parallel to second edge 312 of panel 310, is disposed through and/or is attached to second attachment mechanism 350, and terminates at and is attached to left corner attachment 315 at the corner of panel 310 formed by the intersection of second edge 312 and third edge 313. Second elongated rod 361 begins and is attached to first attachment mechanism 330, is disposed substantially parallel to fourth edge 314 of panel 310, is disposed through and/or is attached to second attachment mechanism 350, and terminates at and is attached to right corner attachment 316 at the corner of panel 310 formed by the intersection of fourth edge 314 and third edge 313. In this way, training apparatus 300 is configured to rotate 360° around the shaft of sports apparatus 30, with exception to inner bearing 331, which is secured to the shaft of sports apparatus 30 and does not move in any direction during operation of training apparatus 300.

Figure 29:
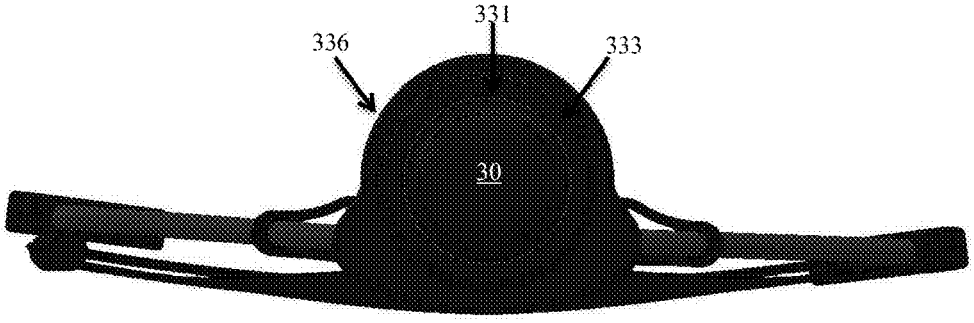
FIG. 29 is an assembled view of the sports swinging exercise and training device attached to the shaft of the sports apparatus from the bottom end of the device.
Figure 30:
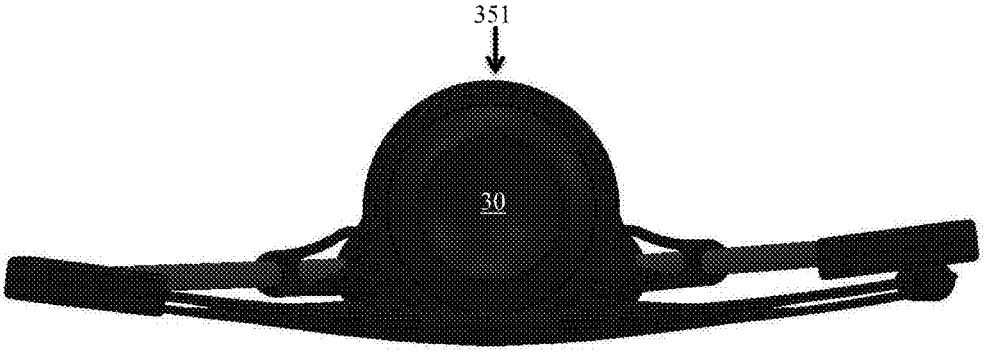
FIG. 30 is an assembled view of the sports swinging exercise and training device attached to the shaft of the sports apparatus from the top end of the device.
Figure 31:
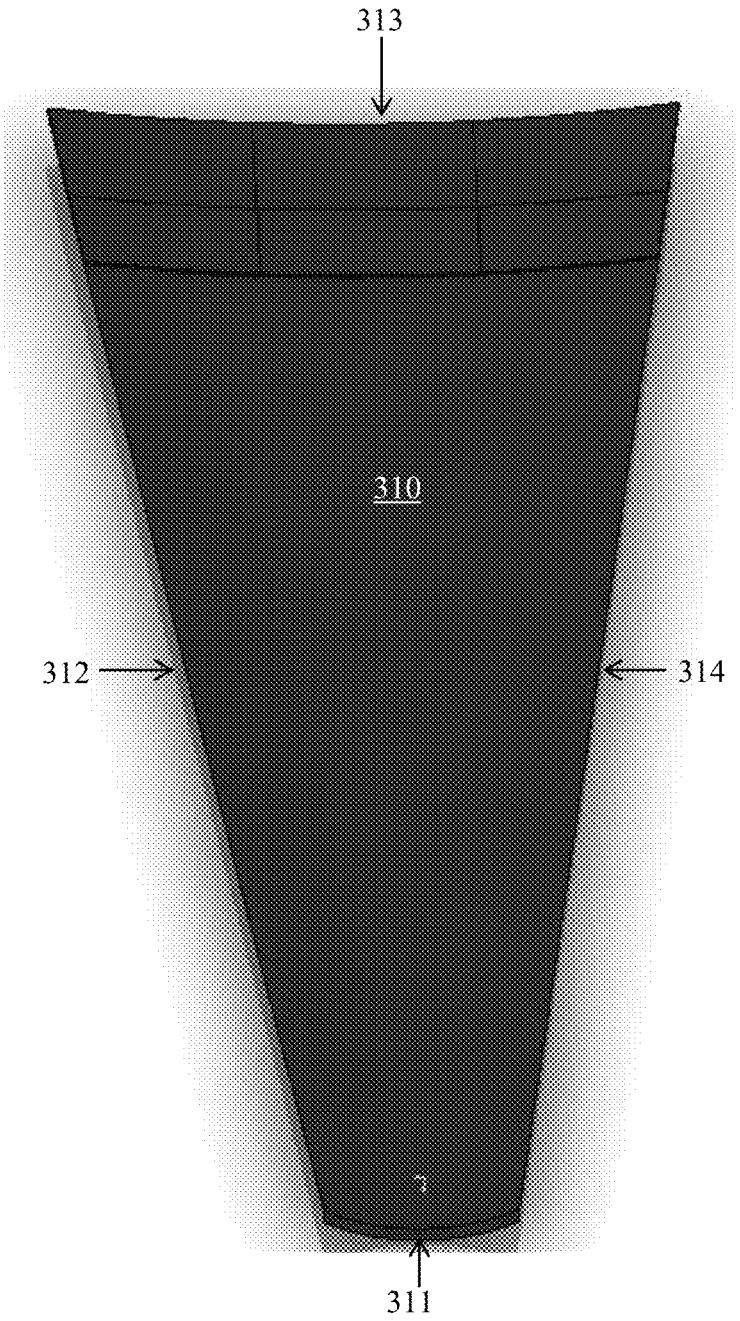
FIG. 31 is a view of the panel of the sports swinging exercise and training device from the front perspective.

FIGS. 29-30 are end views of training apparatus 300 installed on sports apparatus 30.

Referring to FIG. 29, inner bearing 331, outer bearing 333, and first attachment mechanism collar 336 are depicted. Inner bearing 331 can be seen secured around the shaft of sports apparatus 30 and does not move in any direction due to the friction between inner bearing 331 and the shaft of sports apparatus 30. As discussed previously, outer bearing 333 is coupled to and disposed around the perimeter of inner bearing 331 in a manner that permits 360° rotation of outer bearing 333 about the center axis of the shaft of sports apparatus 30. First attachment mechanism collar 336 is disposed around outer bearing 333, such that the rotation of first attachment mechanism collar 336 and outer bearing 333 are synchronized with the remainder of training apparatus 300, with exception to inner bearing 331.

Now referring to FIG. 30, second attachment mechanism collar 351 is laxly disposed around the shaft of sports apparatus 30, thus permitting free rotation of second attachment mechanism 350 about the shaft of sports apparatus 30. It is noted that second attachment mechanism 350 rotates in synchronization with first attachment mechanism 330 about the shaft of sports apparatus 30, due to elongated rods 360, 361 being coupled to corner attachment mechanisms 315, 316 and first attachment mechanism 330 and disposed through second attachment mechanism 350. Thus, the distance between first attachment mechanism 330 and second attachment mechanism 350 remains unchanged during operation of training apparatus 300.

It is contemplated herein that alternative embodiments of the current training apparatus may use different attachment mechanisms to attach and rotate around the shaft of the sports apparatus. They may also use one or more elongated rods to provide rigidity throughout the length of the training apparatus. Overall, the object is to provide a training apparatus that can be coupled to the shaft of a sports apparatus and rotate 360° about the shaft of the sports apparatus. Thus, the panel/airfoil/chute (see FIG. 31 for an isolated view of panel 310 having a substantially trapezoidal shape) provides a drag resistance regardless of the direction of swinging of the sports apparatus.

GLOSSARY OF CLAIM TERMS

Annular: This term is used herein to refer to a structure that is shaped like or forms a ring.

Distal: This term is used herein to refer to a position further from a user operating the underlying sports apparatus and training device.

Laxly: This term is used herein to refer to a structural component being loose or having slack, or otherwise not tense, rigid, or firm.

Panel: This term is used herein to refer to a typically flexible chute or airfoil that provides air resistance when swinging it in a direction normal to its plane.

Proximal: This term is used herein to refer to a position closer to a user operating the underlying sports apparatus and training device.

Rod: This term is used herein to refer to any shaft or bar having a predefined shape. In certain embodiments, the rod can be secured on one end to the proximal attachment mechanism and secured on its opposite end to the stiffener element (e.g., handle). It is contemplated herein that this configuration includes not only a single rod disposed between the proximal attachment mechanism and the stiffener element but also a rod that is disposed between the proximal and distal attachment mechanisms and another rod disposed between the distal attachment mechanism and the stiffener element. In this latter configuration, it is still contemplated that a rod is disposed between the proximal attachment mechanism and the stiffener element; despite the structure being slightly different, it is considered to be equivalent, and the overall function is same.

Simultaneously: This term is used herein to refer to two events occurring at the same time.

Sports apparatus: This term is used herein to refer to equipment that is swung during operation thereof when playing a sport. Examples include, but are not limited to, baseball bats, tennis rackets, golf clubs, and hockey sticks, among other suitable equipment. In a preferred embodiment, the sports apparatus has a shaft that has differing diameters/widths along its length. A particular example of this type of sports apparatus is a baseball bat. In this way, the proximal attachment mechanism would have a diameter that is smaller than the largest diameter of the shaft of the sports apparatus, and the distal attachment mechanism would have a diameter that is larger than the largest diameter of the shaft of the sports apparatus, thus allowing the proximal attachment mechanism to be secured to the shaft during operation and the distal attachment mechanism to substantially freely rotate about the shaft during operation.

Stiffener element: This term is used herein to refer to a structural component that provides a rigidity to an edge of the panel. This rigidity facilitates synchronized rotation of the training device about the shaft of the sports apparatus.

Substantially freely rotate: This term is used herein to refer to the ability of a structure component to turn or revolve around a shaft without obstruction or with minimal obstruction. The term "substantially" is used to indicate that the distal attachment mechanism can rotate about the shaft of the sports apparatus but may have contact the sports apparatus during rotation, thus causing minimal friction to be created between the distal attachment mechanism and the sports apparatus.

Substantially Taut: This term is used herein to refer to a structural component being stretched, pulled tight, or otherwise lacking slack or having minimal slack.

Synchronize: This term is used herein to refer to two events occurring at the same time and with the same speed.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A swinging sports training apparatus for attaching to a shaft of a sports apparatus, comprising:

a first attachment mechanism disposed in proximity to a proximal end of the swinging sports training apparatus, wherein the first attachment mechanism includes a stationary component that is secured and stationary on the proximal end of the swinging sports training apparatus and further includes a rotating component that rotates 360° around a proximal portion of the shaft of the swinging sports training apparatus while the stationary component remains stationary;

a second attachment mechanism disposed around a distal portion of the shaft of the sports apparatus and rotates 360° around the distal portion of the shaft of the sports apparatus, the second attachment mechanism having an inner diameter that is larger than an outer diameter of the distal portion of the shaft of the sports apparatus, such that the entirety of the second attachment mechanism substantially freely rotates about the sports apparatus;

a stiffener element disposed at a distal end of the swinging sports training apparatus;

a first elongated rod having a proximal end and a distal end, the proximal end of the first elongated rod being secured to the first attachment mechanism and the distal end of the first elongated rod being secured to the stiffener element;

a second elongated rod having a proximal end and a distal end, the proximal end of the second elongated rod being secured to the first attachment mechanism and the distal end of the second elongated rod being secured to the stiffener element;

a panel having a proximal end and a distal end, the proximal end of the panel coupled to the first attachment piece and the distal end of the panel coupled to the stiffener element or to the distal ends of the first and second elongated rods, wherein rotation of the first and second attachment mechanisms about the central axis of the shaft of the sports apparatus causes the panel to rotate simultaneously about the shaft, wherein the panel rotates to trail the shaft of the sports apparatus during a swinging motion of the sports apparatus in order to provide resistance during the swinging motion; and wherein the swinging sports training apparatus rotates around the shaft of the sports apparatus in a direction normal to a velocity vector of the swinging motion so that a user of the sports apparatus experiences an increased resistance during the swinging motion, wherein the rotating component of the first attachment mechanism, the second attachment mechanism, the stiffener element, the first elongated rod, the second elongated rod, and the panel collectively rotate in synchronization with each other.

2. The swinging sports training apparatus of claim 1, wherein

The stationary component is an inner bearing immovably secured around the proximal portion of the shaft of the sports apparatus, and the rotating component is an outer bearing disposed around the inner bearing and rotatable about both the inner bearing and the proximal portion of the shaft of the sports apparatus.

3. The swinging sports training apparatus of claim 2, wherein the first attachment mechanism further comprises a collar and a collar cap that house the inner bearing and the outer bearing.

4. The swinging sports training apparatus of claim 2, wherein the inner bearing and the outer bearing each include a raised lip, such that the raised lip of the inner bearing is seated on the raised lip of the outer bearing to prevent the inner bearing from withdrawing out of the outer bearing.

5. The swinging sports training apparatus of claim 1, wherein the first elongated rod and the second elongated rod are each disposed through the second attachment mechanism between the first attachment mechanism and the stiffener element.

6. The swinging sports training apparatus of claim 1, wherein the panel is substantially taut when in use.

7. The swinging sports training apparatus of claim 1, wherein the first and second attachment mechanisms are annular around the shaft of the sports apparatus.

8. The swinging sports training apparatus of claim 1, wherein the stiffener element is a handle disposed across a distal edge of the panel.

9. The swinging sports training apparatus of claim 8, wherein the handle is formed of a front handle and a rear handle that are coupled together and secure the distal edge of the panel therebetween.

10. The swinging sports training apparatus of claim 1, wherein the stiffener element is a corner attachment mechanism each disposed at distal corners of the panel.

11. The swinging sports training apparatus of claim 1, wherein the second attachment mechanism includes a collar and a collar cap disposed around the distal portion of the shaft of the sports apparatus.

12. The swinging sports training apparatus of claim 1, wherein:

the panel has a proximal edge, a distal edge, and side edges connecting the proximal edge to the distal edge, a length of the first elongated rod is substantially parallel to one of the side edges, and a length of the second elongated rod is substantially parallel to another of the side edges.

13. The swinging sports training apparatus of claim 12, wherein the panel has a trapezoidal shape, such that the first and second elongated rods are disposed oblique to one another along the side edges of the panel.

14. The swinging sports training apparatus of claim 1, wherein the first and second elongated rods each have a Young's modulus of at least 10 GPa.

15. The swinging sports training apparatus of claim 1, wherein the first and second elongated rods are symmetrical with respect to each other about the center axis of the sports apparatus.

16. The swinging sports training apparatus of claim 1, wherein the first attachment mechanism has an inner diameter that is smaller than a largest outer diameter of the shaft of the sports apparatus and the second attachment mechanism has an inner diameter that is larger than the largest outer diameter of the shaft of the sports apparatus.

17. A swinging sports exercise and training device for attaching to a shaft of a sports apparatus, comprising:

a first attachment mechanism disposed in proximity to a proximal end of the swinging sports training apparatus, wherein the first attachment mechanism includes a stationary component that is secured and stationary on the proximal end of the swinging sports training apparatus and further includes a rotating component that rotates 360° around a proximal portion of the shaft of the swinging sports training apparatus while the stationary component remains stationary, the stationary component is an inner bearing immovably secured around the proximal portion of the shaft of the sports apparatus, and the rotating component is an outer bearing disposed around the inner bearing and rotatable about both the inner bearing and the proximal portion of the shaft of the sports apparatus, and a collar and a collar cap that house the inner bearing and the outer bearing, wherein the inner bearing and the outer bearing each include a raised lip, such that the raised lip of the inner bearing is seated on the raised lip of the outer bearing to prevent the inner bearing from withdrawing out of the outer bearing;

a second attachment mechanism disposed around a distal portion of the shaft of the sports apparatus and rotates 360° around the distal portion of the shaft of the sports apparatus, the second attachment mechanism having an inner diameter that is larger than an outer diameter of the distal portion of the shaft of the sports apparatus, such that the entirety of the second attachment mechanism substantially freely rotates about the sports apparatus, wherein the second attachment mechanism includes a collar and a collar cap disposed around the distal portion of the shaft of the sports apparatus, wherein the first and second attachment mechanisms are annular around the shaft of the sports apparatus;

a stiffener element disposed at a distal end of the swinging sports training apparatus, wherein the stiffener element is a handle disposed across a distal edge of the panel;

a first elongated rod having a proximal end and a distal end, the proximal end of the first elongated rod being secured to the first attachment mechanism and the distal end of the first elongated rod being secured to the stiffener element;

a second elongated rod having a proximal end and a distal end, the proximal end of the second elongated rod being secured to the first attachment mechanism and the distal end of the second elongated rod being secured to the stiffener element, wherein the first elongated rod and the second elongated rod are each disposed through the second attachment mechanism between the first attachment mechanism and the stiffener element, wherein the first and second elongated rods are symmetrical with respect to each other about the center axis of the sports apparatus, wherein the first and second elongated rods each have a Young's modulus of at least 10 GPa; and a panel having a proximal end and a distal end, the proximal end of the panel coupled to the first attachment piece and the distal end of the panel coupled to the stiffener element or to the distal ends of the first and second elongated rods, wherein rotation of the first and second attachment mechanisms about the central axis of the shaft of the sports apparatus causes the panel to rotate simultaneously about the shaft, wherein the panel is substantially taut when in use, wherein the panel rotates to trail the shaft of the sports apparatus during a swinging motion of the sports apparatus in order to provide resistance during the swinging motion wherein the handle is formed of a front handle and a rear handle that are coupled together and secure the distal edge of the panel therebetween, wherein the panel has a proximal edge, a distal edge, and side edges connecting the proximal edge to the distal edge, such that a length of the first elongated rod is substantially parallel to one of the side edges and a length of the second elongated rod is substantially parallel to another of the side edges, wherein the panel has a trapezoidal shape, such that the first and second elongated rods are disposed oblique to one another along the side edges of the panel, wherein the swinging sports training apparatus rotates around the shaft of the sports apparatus in a direction normal to a velocity vector of the swinging motion so that a user of the apparatus experiences an increased resistance during the swinging motion, wherein the rotating component of the first attachment mechanism, the second attachment mechanism, the stiffener element, the first elongated rod, the second elongated rod, and the panel collectively rotate in synchronization with each other.

* * * * *